United States Patent [19]

Clifford et al.

[11] Patent Number: 4,746,912

[45] Date of Patent: May 24, 1988

[54] EMERGENCY ALARM METHOD AND SYSTEM UTILIZING CROSS CUEING AND RANGING TECHNIQUES

[76] Inventors: Thomas Clifford, 6 Massachusetts Ave., Massapequa, N.Y. 11758; Carl E. Schwab, 34 Longwood Dr., Huntington Station, N.Y. 11746; Bernard L. Jansen, 529 Asharoken Ave., Northport, N.Y. 11768

[21] Appl. No.: 770,923

[22] Filed: Aug. 30, 1985

[51] Int. Cl.[4] ..... G08B 3/00

[52] U.S. Cl. ..... 340/691; 340/539; 340/321; 340/573; 455/100

[58] Field of Search ..... 340/384 R, 384 E, 573, 340/539, 691, 321; 455/95, 100

[56] References Cited

U.S. PATENT DOCUMENTS 4,065,767 12/1977 Neuhof et al. ..... 340/384 R
4,468,656 8/1984 Clifford et al. ..... 340/539

*Primary Examiner*—Joseph A. Orsino
*Assistant Examiner*—Jeffery A. Hofsass
*Attorney, Agent, or Firm*—Pollock, Vande Sande & Priddy

[57] ABSTRACT

An alarm signalling method and system utilizing cross cueing between radio, audio and visible alarm signals which are emitted by an alarm signalling unit. A method and system for measuring the range between the alarm signalling unit and a receiver carried by a rescuer wherein the differences in the time of receipt at the receiver of simultaneously emitted radio and audio signals is used as a measure of range.

12 Claims, 3 Drawing Sheets

FIG. 1
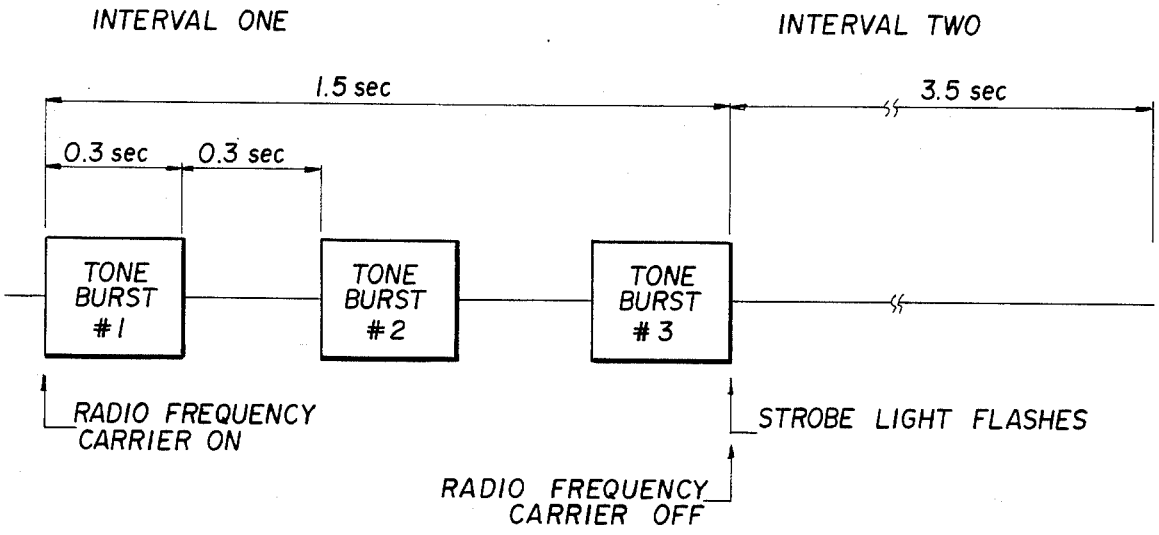
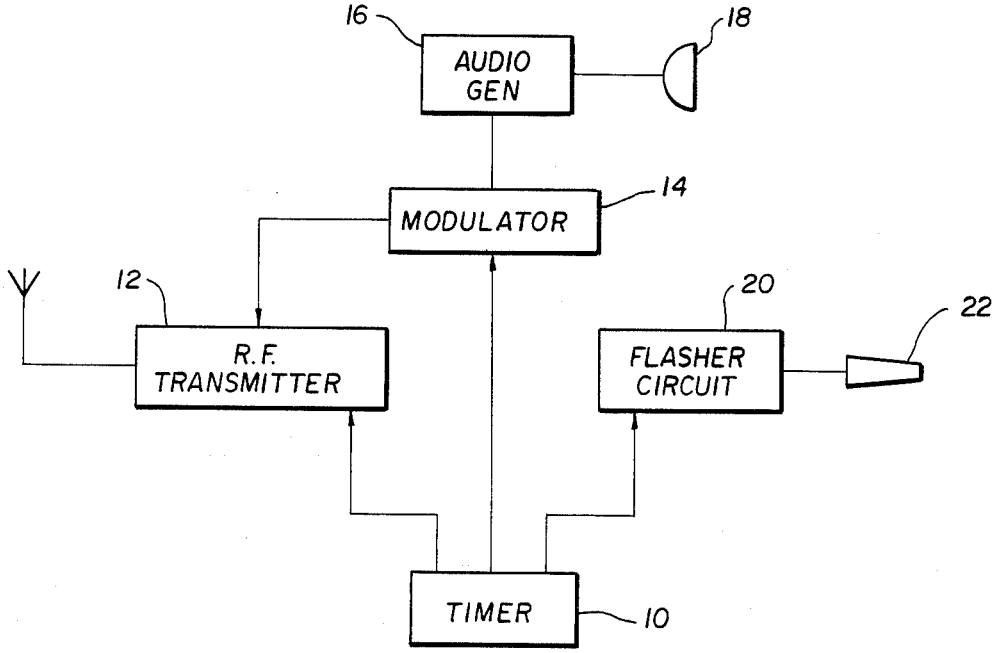
FIG. 2

EMERGENCY ALARM METHOD AND SYSTEM UTILIZING CROSS CUEING AND RANGING TECHNIQUES

The present invention relates to improvements in alarm signalling systems, and more particularly to such systems in which a fireman or other endangered worker carries an alarm signalling unit which emits alarm signals under emergency conditions.

In U.S. Pat. No. 4,468,656 to Clifford et al., which is incorporated herein by reference, an alarm signalling unit which emits radio, audio and visual alarm signals at the same time is described. The radio signal is detected by a radio direction finding unit which is carried by a rescuer who is guided in the general direction of the endangered fireman by the radio signal. As the rescuer gets closer, he is aided by the audio and visual alarm signals being emitted.

In accordance with the present invention a cross cueing feature is introduced which enables the rescuer to more readily identify the alarm signals. In accordance with the cross cueing feature the radio, audio and visual signals are repeated in a cyclic manner, and in a timed, predetermined relationship to each other to facilitate identification by the rescuer.

In accordance with a further aspect of the invention, a ranging feature is provided, which displays the distance to the endangered fireman to the rescuer. The time difference between receipt of simultaneously emitted radio and audio alarm signals is obtained, and is used as a measure of the distance from the rescuer to the alarm signalling unit being carried by the fireman.

It is therefore an object of the invention to provide a cyclical alarm signal which may be distinguished from ambient background.

It is a further object of the invention to provide cross cueing between the different alarm signals which are emitted.

It is still a further object of the invention to provide an indication of range between the rescuer and the endangered worker.

U.S. Pat. No. 4,468,656, which is incorporated herein by reference, describes an alarm signalling unit which utilizes three complementary modes of alarm signalling; radio, audio, and visible light. In accordance with the teaching of that patent, the alarm signalling unit is carried by a fireman or other worker in a dangerous environment, and when the worker is in need of help, he would either manually close a switch, and/or switch means responsive to alarm conditions, for example, lack of motion for a predetermined time, would be automatically closed upon occurrence of such conditions.

The closing of such switch means would place the unit in an alarm signalling mode in which it would generate a modulated carrier radio alarm signal, an audio alarm signal, and a visible alarm signal consisting of light flashes.

The radio signal, which would carry the longest distance, would be the first alarm signal detected by a rescuer. As described in the prior patent, the rescuer would use a radio direction finder to guide him in the direction of the downed fireman. When the rescuer gets close enough, he would begin to hear the audio signal and would follow that, until being close enough to see the visible light flashes. In the chaotic conditions of a fire, sound may bounce off walls and obstructions, and even when the rescuer is very close to the fireman, location by sound alone may be difficult.

It has been discovered that the alarm signalling unit disclosed in the prior patent can be improved by causing the radio, audio, and visible alarm signals to occur in a timed, predetermined relationship to each other, and the present invention is directed to such improvements.

The invention will be better understood by referring to the accompanying drawings in which:

FIG. 1 is a timing diagram which illustrates a preferred timing regime for the cross cueing feature of the invention.

FIG. 2 is a schematic illustration of a system for emitting the alarm signals shown in FIG. 1.

Figure 3:
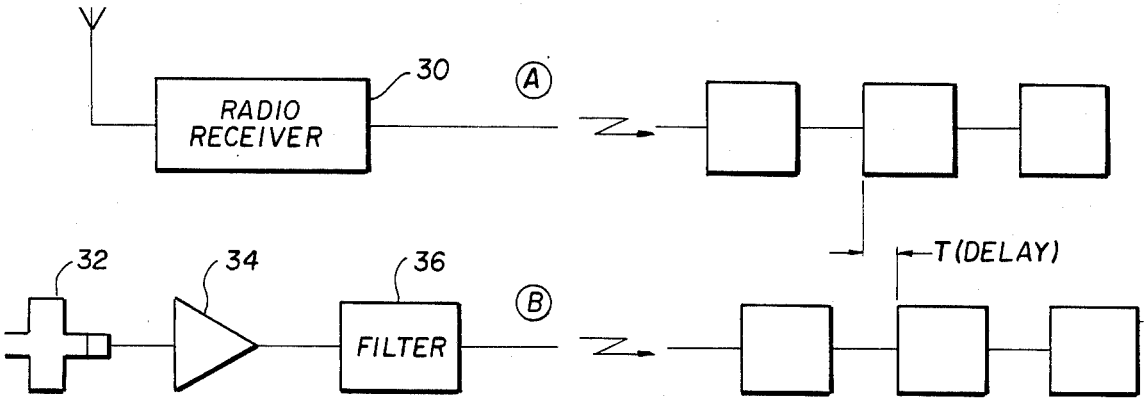
FIG. 3 is a schematic illustration of the front end of a system for measuring range.

The relative timing of the three-alarm disciplines is known as cross cueing, and a preferred illustration thereof is shown in FIG. 1.

Referring to the Figure, time is divided into two intervals, and alarm signals are generated during the first interval, while the alarm sources are silent during the second interval. At the beginning of the first interval, the radio transmitter is turned on for generating the radio carrier, and the carrier signal is turned off at the end of the first interval. During the first interval, the modulator is triggered to provide a predetermined number of successive modulated carrier and audio alarm signals, which in the preferred embodiment consists of three simultaneously generated radio and audio bursts, each of 0.3 seconds duration having an interval of 0.3 seconds between them. As described in U.S. Pat. No. 4,468,656, the modulator is used to both modulate the radio transmitter generating the carrier, and to impress the same modulation on the audio generator. Finally, at the end of the first interval, the flasher circuitry causes the strobe light to flash. In the preferred embodiment, the duration of the first interval is 1.5 seconds while the duration of the second interval is 3.5 seconds.

FIG. 2 is a schematic illustration of the modified alarm signalling unit. A timer 10 is provided, which for example may be comprised of a clock and a counter. The timer has three output lines, A, B, and C, and is arranged so that line A goes high every 5 seconds and remains high for 1.5 seconds to turn radio transmitter 12 on to enable it to generate the radio carrier signal for 1.5 seconds as illustrated in FIG. 1. Line B is arranged to generate the three successive pulses of 0.3 seconds duration for driving modulator 14, with the first pulse set to begin at the beginning of interval one. The modulator output is fed to both radio transmitter 12 for modulating the carrier thereof, and to audio generator 16 for impressing the same modulation on the audio signal. The output of the audio generator is fed to loudspeaker 18 or other audio transducer. Line C of the timer is arranged to go high at the termination of the radio carrier signal, for driving the flasher circuitry 20, which causes strobe light 22 to flash.

It is to be understood that in an actual embodiment the timer outputs A, B and C are fed to the transmitter, modulator, and flasher circuitry through the intermediary of suitable interface circuitry, which is well known to those skilled in the art.

The three signalling disciplines, i.e., radio frequency, acoustic and light are complementary and the rescuer is aided by the transition from one to the other. Under the adverse conditions present in a fire, typically the radio transmission can be received up to 300 meters distance, the acoustic source to at least 30 meters, and the strobe light to at least 3 meters. This is to be contrasted with the situation under quiet outdoor conditions where the acoustic source can be heard to 300 meters or more and at night within line of sight limitations, the light source can be seen for 1,000 meters or more. Under the chaotic conditions such as a fire, the ambient noise reduces the acoustic range and smoke and obstruction drastically reduces the strobe light range.

In the operation of the invention, a fireman or other worker will carry the alarm signalling unit having the cross cueing feature. Upon encountering difficulty and needing to be rescued, he will turn the alarm signalling unit on, or in the alternative, one of the automatic switches described in U.S. Patent No. 4,468,656 will do the same. For example, if the fireman becomes unconscious, after a certain time, for example 30 seconds, the lack of motion detector will begin the alarm sources cycling. The monitor receiver described in the above-mentioned patent will output the alarm tone, and search and rescue efforts will begin.

The rescuers will carry radio direction finding receivers, and will make use of the received signal strength as an indication of forward progress towards the downed fireman.

At some point the acoustic signal will be heard, and the sooner that the acoustic signal is heard the shorter the rescue time will be. This is because that while the radio frequency signal follows a direct line of path from the signalling unit to the receiver, (which could be through walls and other obstructions), the acoustic signal will tend to follow a path more likely passable coming through open doorways, holes in walls, hallways, etc. The earlier that the acoustic signal can be reliably detected, the sooner the rescuers are certain they are on a viable retrieval path.

Cross cueing from the radio receiver to the acoustic path is accomplished by adjusting the radio receiver output so that the rescuer(s) can hear the radio audio and the acoustic signal simultaneously. Because of the slower velocity of sound the acoustic path will have a delay. For example at 30 meters the delay is approximately 0.1 seconds. This produces an echo effect which reduces to near zero when the acoustic path is say 5 meters. Of course as the rescuer(s) progress towards the downed fireman, the acoustic signal gets louder.

The second aspect of the cross cueing is that the strobe light flashes at the end of the third tone burst. In a dense, smokey and likely dark condition, the rescuer(s) may be only a few meters from the downed fireman, but echoes off walls and other structures makes location by sound alone slow. In that last few meters, the strobe light will help pinpoint his location. Knowing when the strobe will occur is a great aid in distinguishing it from other light sources.

In accordance with a further aspect of the invention, a numerical display of the distance from the rescuer to the downed fireman is provided at the radio receiver carried by the rescuer. This is accomplished by measuring the time delay between the receipt of a radio alarm signal at the receiver and the receipt of the corresponding audio or acoustic alarm signal (tone emission). That is, while the radio and acoustic signals are emitted simultaneously, the radio signal is always received first since radio waves travel faster than sound waves, and the time delay between the receipt of the two signals is a measure of the distance between the alarm signalling unit and the receiver. This is explained by the following equation:

$$Td(rf) = D/3*10E8$$

$$Td(\text{acoustic}) = D/330$$

where: D is distance in meters, and Td is time in seconds

We define:

$$Td(\text{diff}) = Td(\text{acoustic}) - Td(rf)$$

Therefore:

$$Td(\text{diff}) = D(1/330 - \tfrac{1}{3}*10E8)$$

$$D = Td(\text{diff})([3*10E8*330]/[3*10E8 - 330])$$

Or:

$$D = Td(\text{diff})*330$$

To receive the audio alarm signals, a microphone is provided at the receiver, and its output is amplified. The received acoustical signal is passed through a band pass filter, for example a Helmholtz acoustic resonator, to discriminate against extraneous acoustic noise.

A schematic illustration of the system is shown in FIG. 3, wherein radio receiver 30 receives radio alarm signals at signal path A, which are illustrated as the three modulated carrier signals shown in FIG. 1. Microphone 32 receives the acoustic alarm signals which are fed to amplifier 34 and filter 36. The time delay between receipt of the radio and audio signals is also depicted in the Figure.

Figure 4:
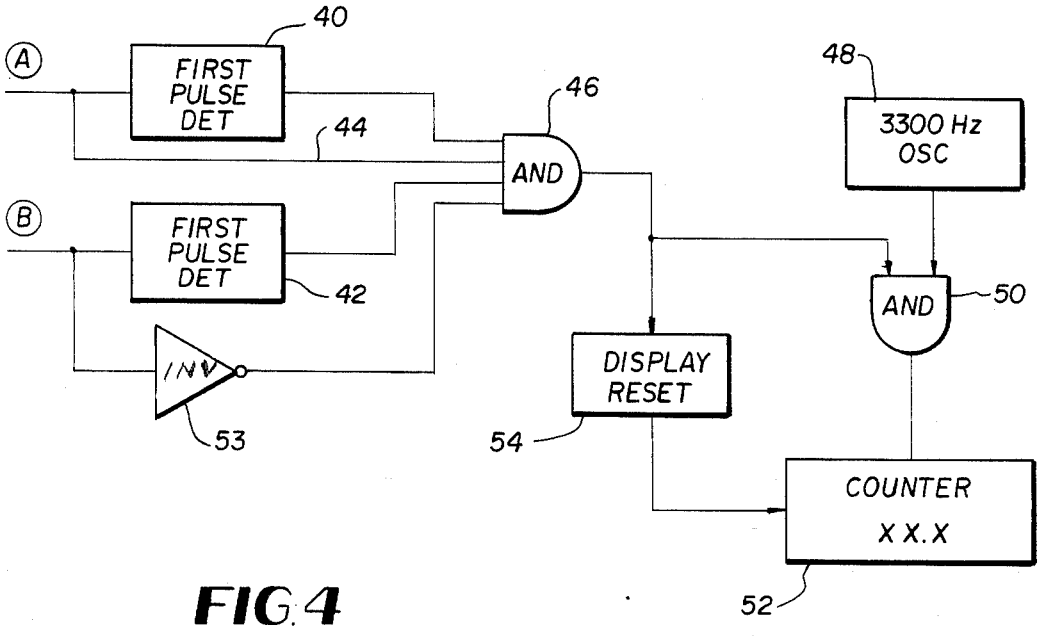
FIG. 4 is a block diagram of an illustrative embodiment of a range measuring system utilizing an interval counting concept.

An embodiment for measuring the time delay which utilizes an interval counting concept is shown in FIG. 4. The leading edges of the second pulses are used to measure the time difference rather than the first pulses since in the case of the first pulses the receiver is receiving a carrier turn-on and modulation at the same time which could result in distortion and possibly result in an error in the range estimate. In the embodiment of FIG. 4, the presence of the first pulse is used to enable the triggering action on the lead edge of the second pulse, which allows effective discrimination against false triggering due to noise spikes from the receiver or transients from the microphone/amplifer combination.

Referring to the Figure, first pulse detectors 40 and 42 are provided which detect the occurrences of the first radio and audio pulses respectively. The details of the first pulse detectors are known to those skilled in the art, and for example they may include a timing means for responding to an interval longer than that occurring between the first and second pulses and second and third pulses.

Thus, after the occurrence of the first radio and audio pulses, the outputs of both first pulse detectors as well as the output of the inverter are high while line 44 is low. The leading edge of the second radio pulse causes line 44 to go high, thus causing the output of AND gate 46 to become high.

A 3,300 Hz oscillator 48 is provided and its output is fed to AND gate 50. Upon the occurrence of the leading edge of the second radio pulse, clock pulses from oscillator 48 are gated through to counter 52.

Upon the occurrence of the leading edge of the second audio pulse, the output of inverter 53 goes low, as does the output of AND gate 46, so that pulses from oscillator 48 stop being fed to the counter.

The count number read out by the counter is the distance in tenths of a meter, and the system is updated every five seconds when used with the timing scheme shown in FIG. 1.

Figure 5:
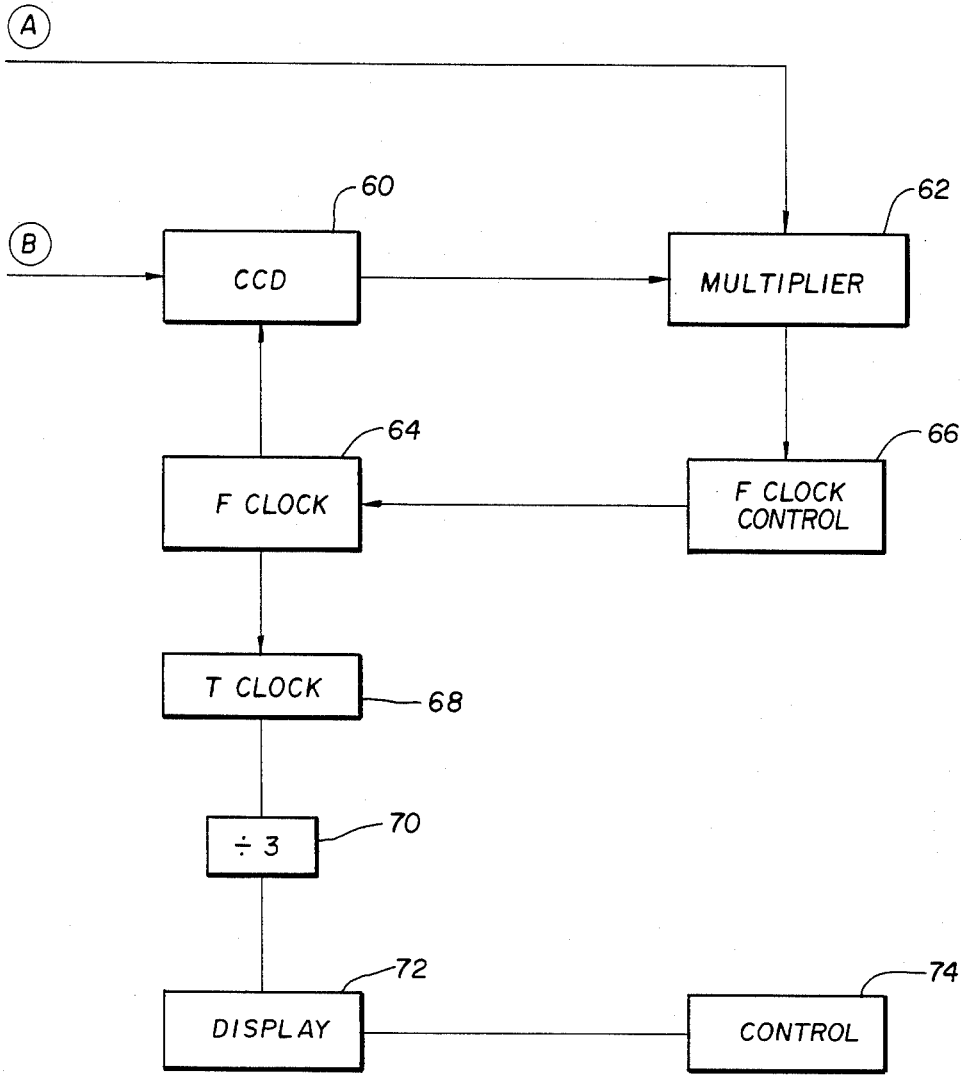
FIG. 5 is a block diagram of an illustrative embodiment of a range measuring system utilizing correlation processing.

A further embodiment for measuring the time delay is illustrated in FIG. 5. The apparatus shown utilizes a correlation processing, and while the processor is more complex then the counting system shown in FIG. 4, it permits operation with poorer quality signals from the radio receiver and microphone/amplifer.

In this embodiment, the radio signals are passed through a CCD (charge coupled device) which is driven by a variable frequency clock. The resultant delayed signal is multiplied with the microphone/amplifer output and is at a maximum value when the time delay through the CCD equals the acoustic time delay.

The delay through a CCD is:

$$T(\text{delay})=[\text{no. of cells}]/[2*\text{Fclock}]$$

Define:

$$\text{Tclock}=1/\text{Fclock}$$

Therefore:

$$T(\text{delay})=[\text{no. of cells}/2]*\text{Tclock}$$

Since:

$$D=T(\text{delay})*330$$

Then:

$$D=\text{Tclock}*K$$

Where:

$$K=[\textit{no. of cells}/2]*330$$

Therefore, by measuring the Tclock period that produces the maximum multiplier output and multiplying it by K, the range in D meters is displayed.

FIG. 5 is a block diagram of the correlation processor showing CCD 60, multiplier 62, Fclock 64, Fclock control 66, Tclock 68, divide by three network 70, display 72 and display control 74.

A typical value for the number of cells in the CCD is 2048. If D=3.3 meters, then T(delay)=0.1 seconds and Tclock=0.1*2/2048=9.77*10E-6. For D=20 meters, T(delay)=0.0606 seconds and Tclock=0.0606*2/2048=59.2*10E-6. To a very close approximation if the Tclock period in microseconds is divided by 3 the resulting value is the range D in meters. Thus for D=3.3 meters the display will show 9.77/3 or 3.26 meters. Likewise for D=20 meters the display will show 59.2/3 or 19.73 meters.

There thus have been disclosed improvements in alarm signalling methods and systems.

It should be appreciated that while the improvements have been disclosed in connection with preferred embodiments, many variations which fall within the scope of the invention may occur to those skilled in the art. Therefore, the scope of the invention is to be limited solely by the claims appended hereto and equivalents.

We claim:

1. A method of operating an emergency signalling unit worn by a fireman or other worker in a potentially dangerous environment, which emits at least audio and visible alarm signals, comprising, arranging said audio alarm signals to occur in a cyclical manner, wherein each cycle comprises a first interval consisting of a predetermined number of successive tone emissions occurring in predetermined time relationship to each other and a second interval which is longer than said first interval during which no tone emissions occur, and arranging said visible alarm signal to be emitted immediately following a predetermined one of said successive tone emissions.

2. The method of claim 1 wherein said visible alarm signal occurs as the end of the last tone emission in the first interval.

3. The method of claims 1 or 2 wherein said signalling unit also emits radio alarm signals, which are emitted at the same times as said tone emissions.

4. The method of claim 3 wherein the radio alarm signals are modulated carrier signals.

5. The method of claim 4 wherein the carrier of said modulated carrier signals begins at the beginning of said first interval and ends at the end of said first interval.

6. In emergency signalling in which an alarm signalling unit carried by a fireman or endangered worker emits audio alarm signals and radio alarm signals which are received by a rescuer trying to move towards the fireman or worker, the method comprising, arranging said radio and audio signals to be emitted by said signalling unit at the same time, and measuring the time delay at the rescuer between the receipt of the radio and audio signals, which delay is a measure of the distance between the rescuer and the fireman or endangered worker who is carrying the signalling unit.

7. An emergency signalling system comprising, an emergency signalling unit for being carried by a fireman or endangered worker, said signalling unit being comprised of, means for emitting an audio alarm signal, and means for emitting a radio alarm signal at the same times that said audio alarm signal is emitted, a receiving unit for being carried by a rescuer, which is comprised of, a signal receiving means for receiving said radio signal, audio signal receiving means for receiving said audio signal, means for measuring the time difference between receipt of said radio and audio signals, and means for displaying a number derived from said measured time which is representative of the distance between the rescuer and the fireman or worker carrying the signalling unit.

8. The emergency signalling system of claim 7 wherein the means for measuring the time difference comprises, counter means, clock means for providing clock pulses which are fed to said counter means, and gate means arranged to open at receipt of said radio signal and close at receipt of said audio signal for allowing clock pulses from said clock means to be fed to said counter means.

9. The emergency signalling system of claim 8 wherein said means for emitting an audio alarm signal emits a cyclical pattern of audio alarm signals and wherein said means for emitting a radio alarm signal emits a corresponding pattern of radio alarm signals, and further wherein said gate means is arranged to open at receipt of a radio signal in said pattern which occurs after the first radio signal in said pattern, and to close at the receipt of the corresponding audio signal.

10. The system of claim 9 wherein said signal which occur after the first signal is the second signal.

11. The emergency signalling system of claim 7 wherein said means for measuring the time difference comprises, means for delaying the received radio signal by varying amounts, means for multiplying said variably delayed signal by the received audio signal, means for detecting when the output of said means for multiplying is a maximum, which is caused by an introduced delay which corresponds to the difference in time between receipt of said radio signal and receipt of said audio signal, and means for displaying a number which is derived from said difference in time, which is representative of the distance between the receiving unit and an alarm signalling unit.

12. The emergency signalling system of claim 11 wherein said means for delaying comprises a charge coupled device driven by a variable frequency clock.

* * * * *